US006837026B2

(12) United States Patent
Setton

(10) Patent No.: US 6,837,026 B2
(45) Date of Patent: Jan. 4, 2005

(54) PRE-FILLED PERSONAL HYDRATION RESERVOIR

(75) Inventor: David Setton, 3939 Cerrito Ave., Oakland, CA (US) 94611

(73) Assignee: David Setton, Oakland, CA (US)

( * ) Notice: Subject to any disclaimer, the term of this patent is extended or adjusted under 35 U.S.C. 154(b) by 0 days.

(21) Appl. No.: 10/251,707

(22) Filed: Sep. 20, 2002

(65) Prior Publication Data

US 2004/0055254 A1 Mar. 25, 2004

(51) Int. Cl.[7] ..... B65B 11/58; B65B 61/00

(52) U.S. Cl. ..... 53/412; 53/410; 53/449; 53/469; 222/175; 224/148.4; 224/148.5

(58) Field of Search ..... 53/412, 459, 469, 53/473, 133.2, 133.4, 139.2, 410, 449; 224/148.4, 148.5; 222/95, 175

(56) References Cited

U.S. PATENT DOCUMENTS 3,263,806 A * 8/1966 Ring ..... 224/148.4
4,095,726 A * 6/1978 Hechler et al. ..... 222/175
4,394,936 A * 7/1983 Shavit ..... 222/107
4,739,905 A * 4/1988 Nelson ..... 222/145.4
4,993,611 A * 2/1991 Longo ..... 224/148.4
5,060,833 A * 10/1991 Edison et al. ..... 224/148.5
5,722,573 A 3/1998 Carnel ..... 224/148.2
5,727,714 A 3/1998 Fawcett ..... 222/175
5,851,072 A 12/1998 LaFleur ..... 383/66
6,000,848 A 12/1999 Massioui ..... 383/80
6,090,029 A 7/2000 LaFleur ..... 493/213
6,247,619 B1 6/2001 Gill et al. ..... 222/105
6,401,993 B1 * 6/2002 Andrino ..... 224/148.5
6,422,439 B1 * 7/2002 Kelliher et al. ..... 224/148.5

* cited by examiner

*Primary Examiner*—John Sipos
(74) *Attorney, Agent, or Firm*—James D. Ivey

(57) ABSTRACT

A beverage reservoir for a personal hydration device is filled with a beverage, e.g., water, and sealed in a tamper-evident manner. As a result, the reservoir can be sold pre-filled and the user can use the reservoir confident that the beverage contains no mold, fungus, or residue from previously stored and consumed beverage. The reservoir can also include a port for re-filling such that the user can use the reservoir in a conventional manner after consumption of the previously sealed-in beverage.

7 Claims, 6 Drawing Sheets

PRE-FILLED PERSONAL HYDRATION RESERVOIR

FIELD OF THE INVENTION

This invention relates to the field of beverage containers for active sports use, and more specifically to a particularly convenient reservoir for personal hydration and a method for making such a reservoir.

BACKGROUND OF THE INVENTION

The importance of maintaining hydration while engaging in strenuous physical activity is well known. Recently, personal hydration devices have been developed which allow users to carry large amounts of liquids and drink more or less continuously during long periods of physical activity. These devices typically have a bag-like water reservoir that is carried in small, back-mounted packs and, more recently, backpacks of all sizes. A long flexible hose is connected to the reservoir at one end and terminates in a mouth piece at the other end. The hose is long enough to allow the user to carry the mouth piece and draw water from the reservoir at will during vigorous activity such as hiking or cycling.

Initial designs of the refillable reservoir suffered from two main limitations: restricted flow of the beverage at the junction between the hose and the reservoir and difficulty in cleaning the reservoir. Flow of the beverage is restricted when the user applies suction to the hose in an effort to drink and the reservoir collapses as the hose junction thereby forming an unwanted seal at the hose's end. Cleaning the reservoir is very important and difficult due to small diameters in the hose and a filling port in the reservoir. After a reservoir has been used to carry water, mold and/or fungus typically forms in the reservoir due to persistent moisture in the reservoir. After a reservoir has been used to carry sports beverages such as Gatorade®, a sticky residue remains and repeated fillings of such sports beverages eventually render the reservoir unusable.

More recent designs of hydration devices have been mostly successful of overcoming there early deficiencies. However, such recent designs still grow mold and/or fungus in the drinking hose due to lack of ventilation and are still difficult to clean despite larger fill openings. What is needed is a reservoir for a personal hydration device wherein difficulty in cleaning the reservoir is mitigated substantially.

SUMMARY OF THE INVENTION

In accordance with the present invention, a reservoir for use with a personal hydration pack is sealed in a tamper-evident manner while pre-filled with a beverage. Such indicates to the user that the beverage is clean, fresh, and free of contaminants from prior usage. In addition, the reservoir can be filled by a manufacturer of beverages and/or personal hydration reservoirs such that the end user purchases the reservoir pre-filled. Accordingly, use of the personal hydration reservoir is particularly convenient since filling of the reservoir by the user is obviated. More importantly, since many active people purchase bottled water or commercially available sports drinks for use in personal hydration devices, extraneous disposable containers in which such beverages are typically sold can be eliminated, thereby reducing costs and recyclable and non-recyclable waste.

The reservoir can be formed with a drinking hose attached and the beverage can be sealed with the drinking hose attached. In fact, the reservoir can be filled through the attached drinking hose and then sealed at the proximal end of the drinking hose. The reservoir can also be filled by welding the reservoir about the majority of its perimeter prior to filling and welding the remainder of the perimeter subsequent to filling.

The reservoir can include a sealed, tamper-evident re-filling port such that the reservoir can be used in a conventional manner after consumption of the previously sealed-in beverage. Accordingly, particularly active people can re-fill the reservoir if the originally supplied beverage is depleted prior to completion of a particularly long and strenuous period of high activity. For example, a cyclist on a particularly long ride can re-fill a depleted reservoir at any source of water to continue the ride without risking dehydration. By making the re-fill port tamper-evident, the user can be sure that the sealed-in beverage is clean, fresh, and free of contaminants despite the presence of the re-fill port.

DETAILED DESCRIPTION

In accordance with the present invention, personal hydration pack 10 includes a reservoir 20 which is pre-filled with a beverage and is sealed in a tamper-evident manner. Pre-filling reservoir 20 with a beverage prior to sealing in a tamper-evident manner eliminates the need for the user to fill reservoir 20 and therefore also eliminates waste containers such as plastic bottles in which the user would otherwise have purchased a beverage with which to fill reservoir 20. In addition, making pre-filled reservoirs such as reservoir 20 available to end-users encourages such end-users to purchase new reservoirs rather than risk build-up of mold and/or fungus in improperly cleaned, used reservoirs.

Reservoir 20 is positioned within personal hydration pack 10 as shown with personal hydration pack 10 shown cut-away. Personal hydration pack 10 includes two holes 12A–B through which drinking hose 22 of reservoir 20 can pass for drinking by a user during any of a number of physical activities such as hiking, cycling, skating, rowing, etc. In this illustrative embodiment, hose 22 terminates at a bite valve 24 which the user can bite to facilitate flow of a beverage contained within reservoir 20.

Figure 2:
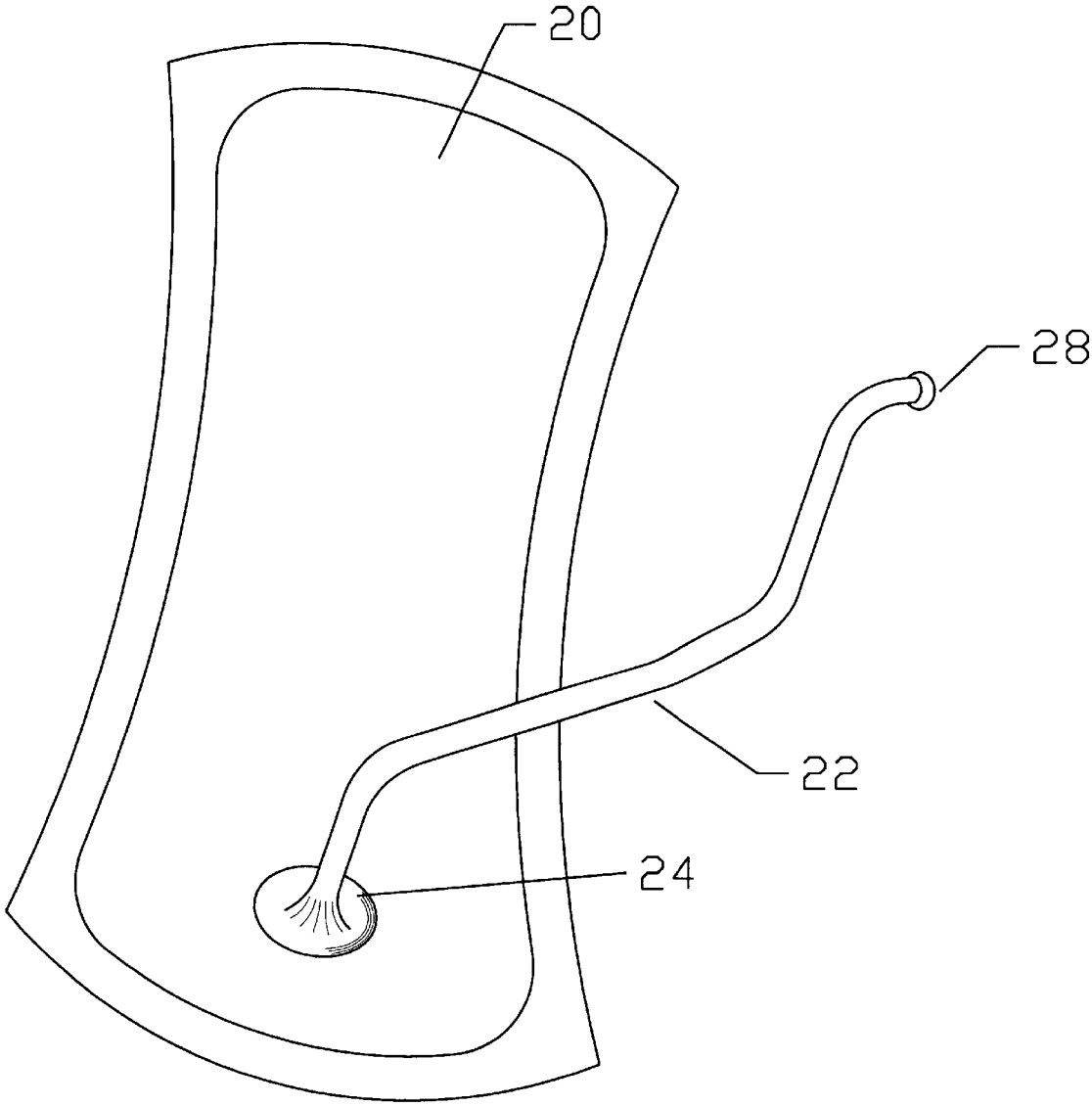
FIG. 2 is an illustration of a personal hydration reservoir in accordance with the present invention.
Figure 3:
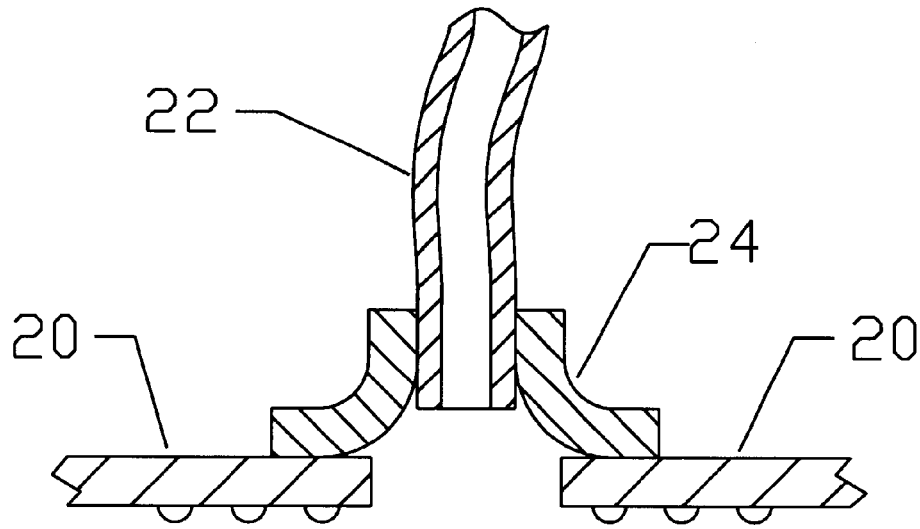
FIG. 3 is a cross-section view of a fitting between a reservoir and drinking hose in accordance with the present invention.
Figure 4:
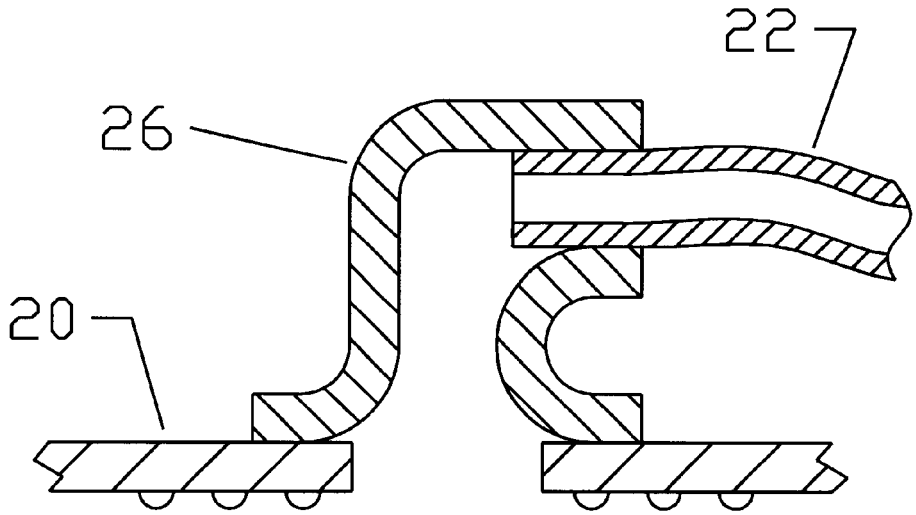
FIG. 4 is a cross-section view of an alternative fitting to that shown in FIG. 3.

Reservoir 20 is shown in isolation in FIG. 2. Reservoir 20 is pre-filled with a beverage and is a plastic bag which is sealed by being welded about its perimeter with the beverage enclosed. Reservoir 20 includes a hose fitting 24 which is welded to reservoir 20 and to drinking hose 22 to form a permanent seal between reservoir 20 and drinking hose 22. In an alternative embodiment, hose fitting 24 is replaced with an angled hose fitting 26 (FIG. 4). In another alternative embodiment, hose fitting 24 is replaced with an exit valve described in U.S. Pat. No. 5,727,714 to Fawcett and that description is incorporated herein by reference.

Drinking hose 22 is welded to form a seal at proximal end 28. In one embodiment, reservoir 20 is welded around its perimeter and drinking hose 22 is fixed to reservoir 20 by hose fitting 24 prior to filling of reservoir 20 with a beverage. The beverage is then sealed within reservoir 20 by welding proximal end 28 of drinking hose 22. In an alternative embodiment, proximal end 28 of drinking hose 22 is sealed and drinking hose 22 is affixed to reservoir 20 in the manner described herein and a majority of the perimeter of reservoir 20 is welded prior to filling reservoir 22 with a beverage. After filling, the remainder of the perimeter of reservoir 20 is welded to seal in the beverage. In one illustrative example embodiment, the materials and techniques used are those described in the following U.S. Patents which are incorporated herein by reference:

| Inventor(s) | U.S. Pat. No. | Issue Date |
|---|---|---|
| L. Doyen et al. | 3,192,095 | June 29, 1965 |
| Boquet & Doyen | 4,023,700 | May 17, 1977 |
| Aquetant & Doyen | 4,010,786 | Mar. 8, 1977 |
| Doyen & Doyen | 3,935,993 | Feb. 3, 1976 |
| Doyen & Doyen | 3,637,133 | Feb. 25, 1972 |
| Doyen | 3,583,132 | June 8, 1971 |
| Doyen | 3,514,061 | May 26, 1970 |
| Doyen et al. | 3,380,646 | Apr. 30, 1968 |

In either embodiment, the user adapts reservoir 20 for drinking by cutting off the welded portion of proximal end 28 and affixing bite valve 24 to the now-open proximal end 28 of drinking hose 22. Thus, cutting of proximal end 28 of drinking hose 22 evidences a break of the seal of reservoir 20. Such is important in that tamper-evident sealing of reservoir 20 enables retail sale of reservoir 20 pre-filled with a beverage.

Figure 5:
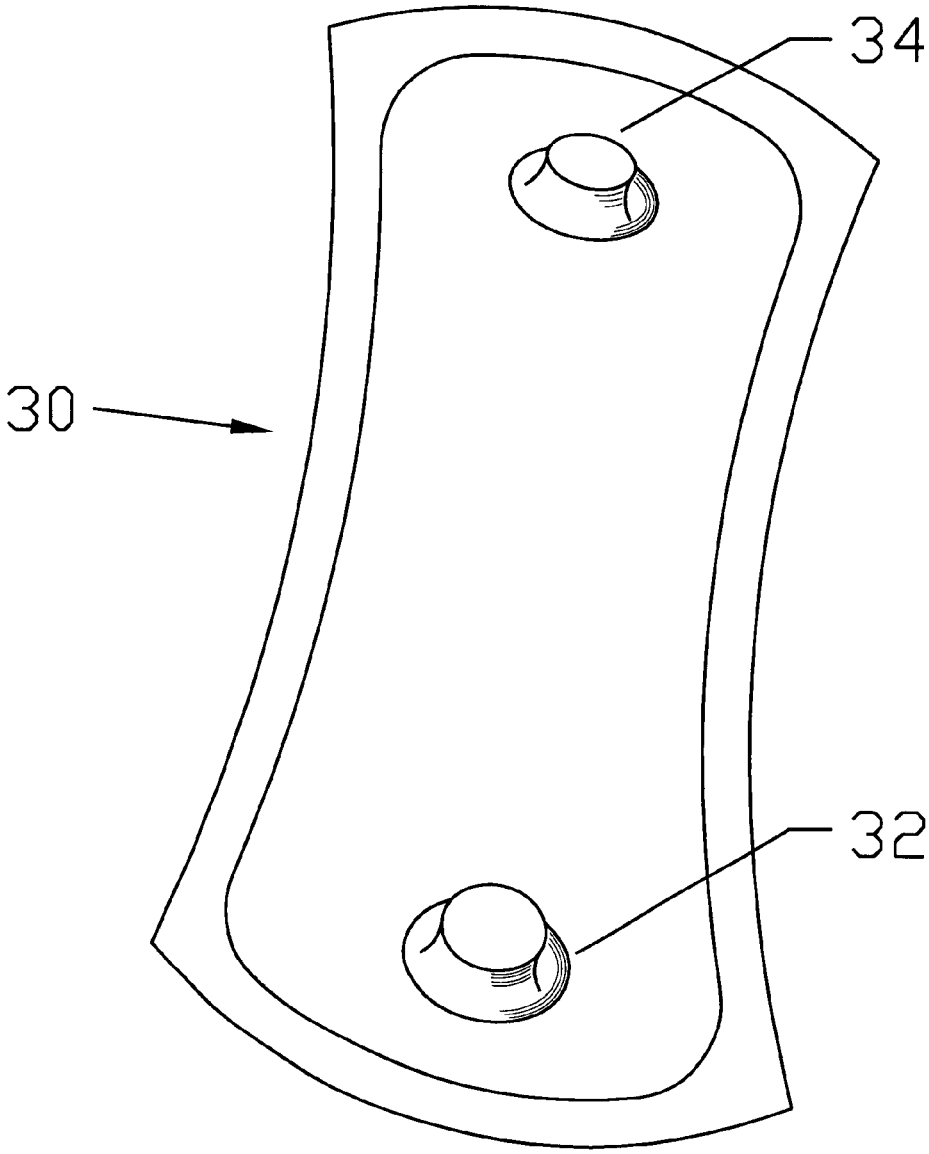
FIG. 5 is an illustration of an alternative personal hydration reservoir in accordance with the present invention.
Figure 6:
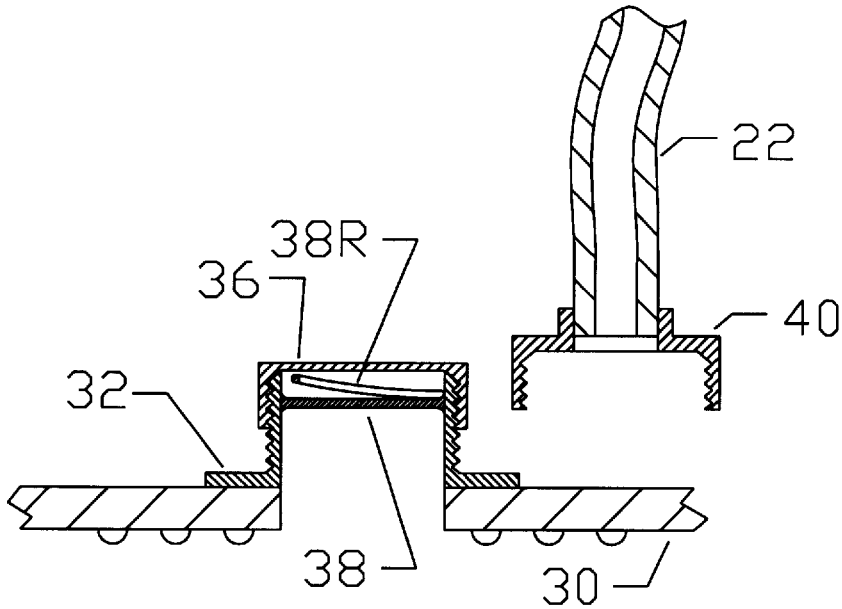
FIG. 6 is a cross-section view of a fitting between the reservoir of FIG. 5 and a drinking hose.

An alternative embodiment is shown in FIG. 5. Reservoir 30 includes two sealed, tamper-evident access ports 32 and 34. Each of ports 32 and 34 can be of the form illustrated in FIG. 6. For illustration purposes, port 32 is described in the context of FIG. 6 but it should be appreciated that description of port 32 in conjunction with FIG. 6 is equally applicable to port 34.

Port 32 is welded to reservoir 30 and has a threaded exterior annular surface which mates with a threaded cap 36. Port 32 is sealed by a user-removable seal 38 which, in this illustrative embodiment, is a ring-pull seal such as those used on conventional and currently available milk and juice cartons and which can be easily removed by a user without tools by simply pulling on a ring 38R after removing cap 36. The user attaches drinking hose 22 by screwing a hose fitting cap 40 onto port 32. Hose fitting cap 40 is sealed to drinking hose 22 as shown.

Port 34 is provided as an alternative port for re-filling reservoir 30 after consumption of the beverage pre-filled into reservoir 30 if the user so desires. Port 34 is also sealed and tamper-evident after initial filling.

Figure 7:
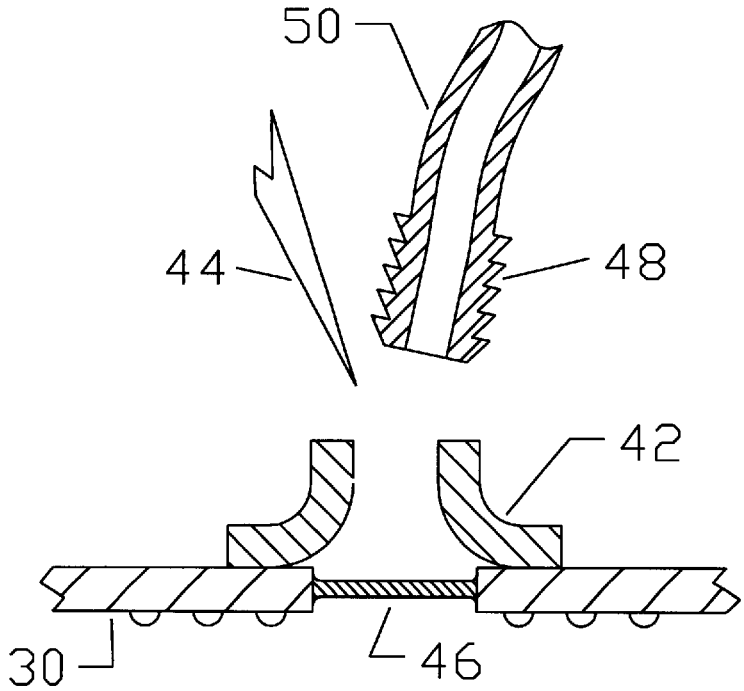
FIGS. 7–9 are cross-section views of alternative fittings between the reservoir of FIG. 5 and a drinking hose.
Figure 8:
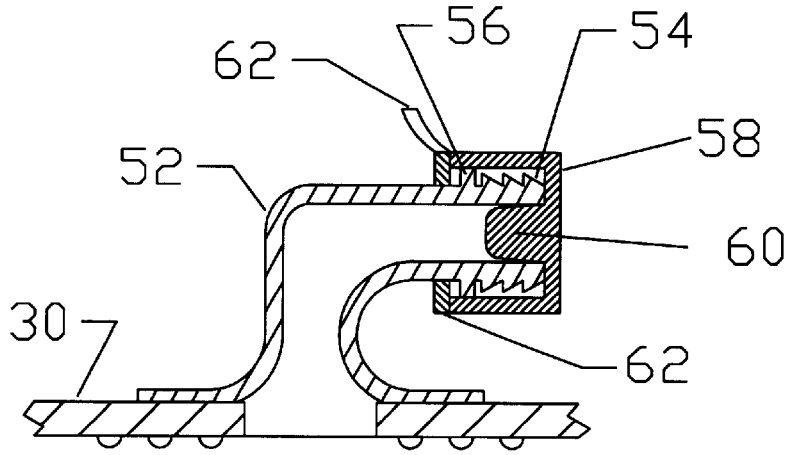
Figure 9:
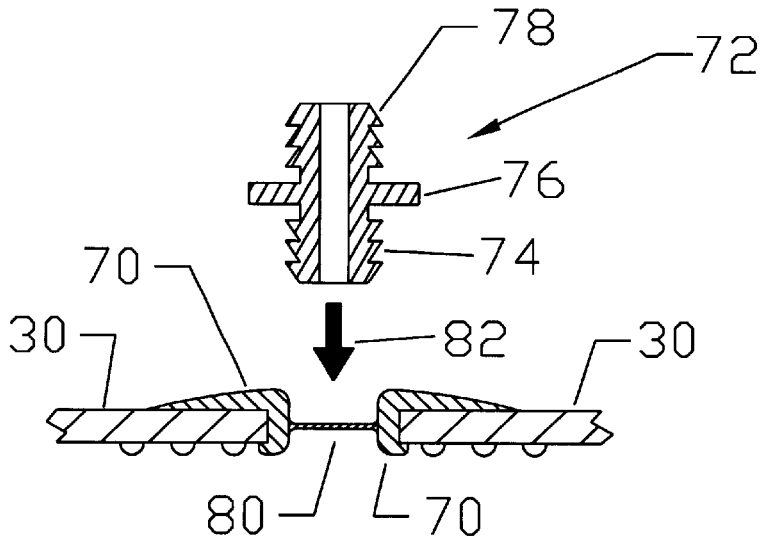

Unlike with reservoir 20 described above, drinking hose 22 can be preserved and reused with multiple instances of reservoir 30. Alternatives to port 32 which are similarly sealed and tamper-evident are shown in FIGS. 7–9. In all such embodiments, reservoir is formed completely, including ports 32 and 34 or alternatives thereof, and is welded around a majority of the perimeter of reservoir 30. Reservoir 30 is then filled with a beverage and the remainder of the perimeter of reservoir 30 is sealed to completely seal in the beverage in such a manner that accessing the beverage requires breaking the seal of reservoir 30 in a clearly evident manner.

FIG. 7 shows port 42 which is an alternative to port 32. Port 42 is welded to reservoir 30 in a conventional manner. However, reservoir 30 includes a thin sealing membrane 46 which can be punctured by the user using a sharp instrument 44, such as an ice pick. In some embodiments, a suitable sharp instrument made inexpensively of hard plastic can be distributed with reservoir 30. In the embodiment shown in FIG. 7, a drinking hose 50 which is generally analogous to drinking hose 22 includes a soft rubber barbed distal end 48 for inserting into port 42. Barbed distal end 48 facilitates insertion into port 42 and sealing with port 42 and resists inadvertent extraction of barbed distal end 48 from port 42.

The user accesses the beverage sealed in reservoir 30 through port 42 by (i) piercing seal membrane 46 with sharp instrument 44 and (ii) inserting barbed distal end 48 into port 42.

FIG. 8 shows an alternative embodiment in which an angled port 52 is welded to reservoir 30. Angled port 52 includes a barbed end 54 over which drinking hose 22 can be placed. Barbed end 54 includes an annular stop 56. A cap 58 is press fit over barbed end 54 and over annular stop 56 to form a seal about annular stop 56. A tear-away ring 62 is attached to, or alternatively formed with, cap 58 to hold cap 58 in position over barbed end 54. Tear-away ring 62 is positioned such that breaking the seal between cap 58 and annular stop 56 requires a permanent and evident alteration to tear-away ring 62 to thereby evidence breaking of the seal. In addition, cap 58 includes a plug 60 which forms another seal with barbed end 54.

FIG. 9 shows an alternative embodiment in which a rigid port 70, made of rigid plastic in this illustrative embodiment, is welded to reservoir 30 to form a drinking port. The drinking port of rigid port 70 is sealed by a user-breakable sealing membrane 80. The beverage is sealed within reservoir 30 in the manner described above. To access the beverage, the user pierces membrane 80 with barbed end 74 of a barbed connector 72 as indicated by arrow 82. Barbed connector 72 includes a center annular flange 76 which forms a seal against rigid port 70 as barbs of barbed end 74 hold barbed connector 72 in place within rigid port 70. The user then fits drinking hose 22 over barbed end 78 of barbed connector 72.

Figure 10:
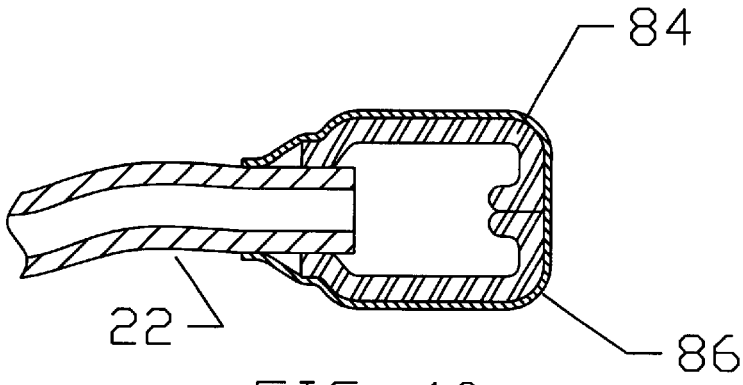
FIG. 10 is a cross-section view of a sealed bite valve at a proximal end of a drinking hose.

An alternative configuration of drinking hose 22 is shown in FIG. 10. A bite valve 84 is welded to, formed with, or alternatively press fit onto drinking hose 22. Bite valve 84 and a portion of drinking hose 22 are encased by a heat-shrink seal 86 which is removed by the user to drinking from bite valve 84. Removal of heat-shrink seal 86 is evident such that a user can be assured that the beverage has not been accessed since sealing of heat-shrink seal 86.

Figure 1:
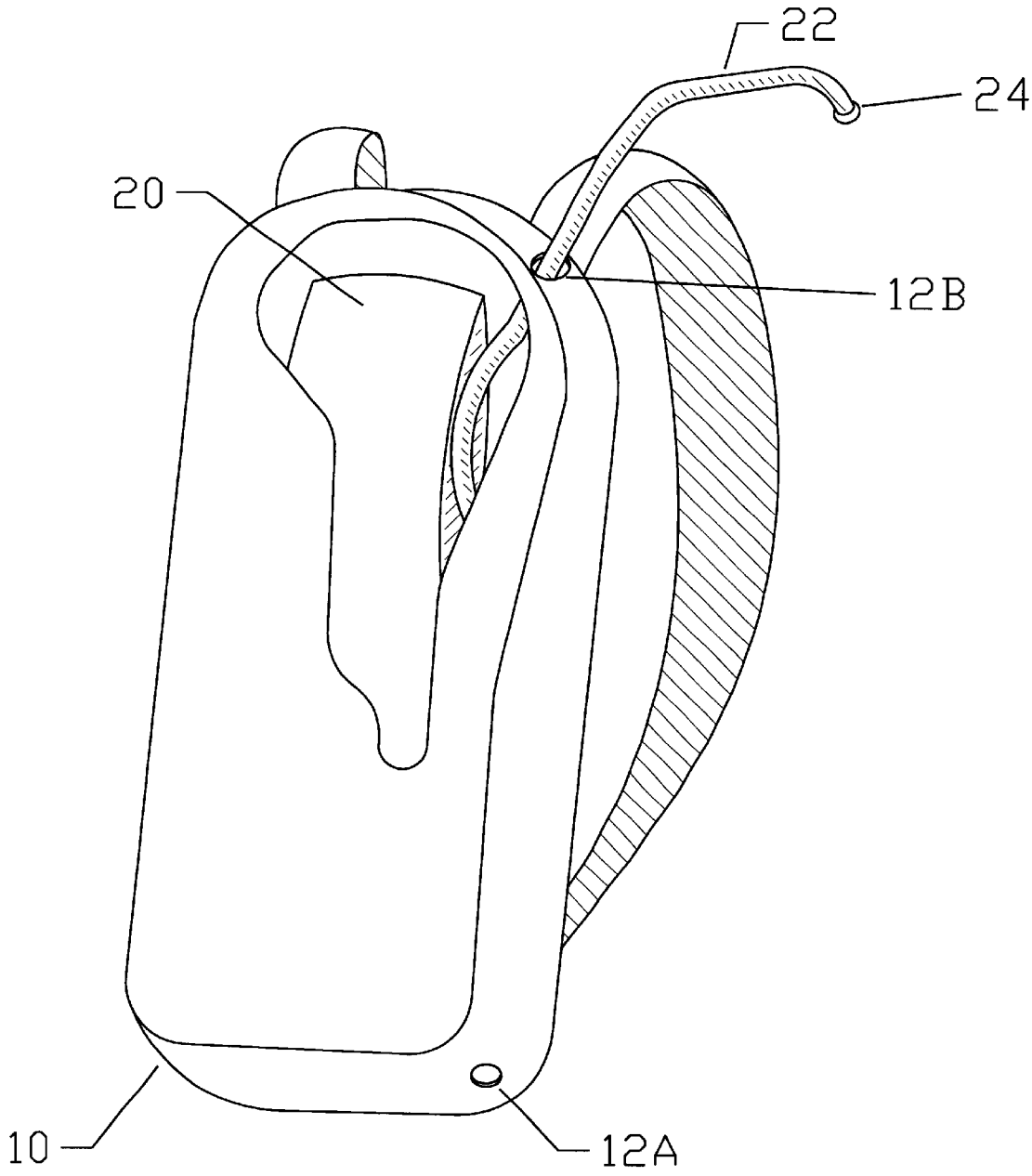
FIG. 1 is a cut-away illustration of a personal hydration pack and a reservoir in accordance with the present invention.

In another embodiment, personal hydration pack 10 (FIG. 1) is obviated altogether by attaching inexpensive shoulder straps directly to reservoir 20. Specifically, the welded perimeter of reservoir 20 (FIG. 2) provides a place for welding of ends of shoulder straps such that reservoir 20 can be carried directly on the back of a user without personal hydration pack 10 (FIG. 1). Similarly, a waist strap can be attached directly to reservoir 20 in an analogous manner. Such straps can be made adjustable using conventional techniques.

The above description is illustrative only and is not limiting. For example, while welding is described herein as one embodiment for sealing a beverage in a flexible bag container, it should be appreciated that generally any technique for sealing a beverage in a flexible bag container can be used. It is also preferred that the reservoir support labeling in accordance with any applicable jurisdiction for the sale of pre-packaged beverages, including direct printing of content information on reservoir 20 and adhesive, pre-printed labels bearing such requisite information. The present invention is defined solely by the claims which follow and their full range of equivalents.

What is claimed is:

1. A method for forming a personal hydration device which includes carrier means for being carried by a user and a carcass attached to the carrier means wherein the carcass is designed to enclose a substantial majority of a reservoir and further wherein the reservoir is designed to store a beverage and to facilitate drinking of the beverage by the user while the reservoir is carried within the carcass of the personal hydration device, the method comprising:

forming a body of the reservoir in a shape which is adapted for use in conjunction with the personal hydration device;

filling the body with a beverage;

sealing the beverage within the body in such a manner that access to the beverage within the body evidences breaking of the seal; and placing the seal and reservoir within the carcass of the personal hydration device.

2. The method of claim 1 further comprising:

attaching a drinking hose to the body prior to filling the body with the beverage such that the beverage is sealed within the body with the drinking hose attached.

3. The method of claim 2 further comprising:

attaching a bite valve to the drinking hose prior to filling the body with the beverage such that the beverage is sealed within the body with the bite valve attached.

4. The method of claim 1 further comprising:

attaching a re-fill port to the prior to filling the body with the beverage such that the beverage is sealed within the body with the re-fill port attached.

5. The method of claim 1 further comprising:

attaching one or more straps to the body such that the reservoir can be carried using the one or more straps without the personal hydration device.

6. The method of claim 5 wherein the one or more straps include two shoulder straps.

7. The method of claim 5 wherein the one or more straps include a waist strap.

* * * * *